US008426719B2

(12) United States Patent
Shim

(10) Patent No.: US 8,426,719 B2
(45) Date of Patent: Apr. 23, 2013

(54) KEYTAR CONTROLLER WITH PERCUSSION PADS AND ACCELEROMETER

(75) Inventor: Brian R. Shim, Providence, RI (US)

(73) Assignee: inMusic Brands, Inc., Cumberland, RI (US)

( * ) Notice: Subject to any disclaimer, the term of this patent is extended or adjusted under 35 U.S.C. 154(b) by 0 days.

(21) Appl. No.: 13/463,462

(22) Filed: May 3, 2012

(65) Prior Publication Data

US 2012/0297961 A1 Nov. 29, 2012

Related U.S. Application Data

(60) Provisional application No. 61/489,876, filed on May 25, 2011.

(51) Int. Cl.
*G10H 1/32* (2006.01)
*G10H 3/00* (2006.01)

(52) U.S. Cl.
USPC ..... 84/743; 84/645

(58) Field of Classification Search ..... 84/743, 84/645
See application file for complete search history.

(56) References Cited

U.S. PATENT DOCUMENTS 3,541,912 A * 11/1970 Radke ..... 84/715
3,555,166 A * 1/1971 Gasser ..... 84/600
4,126,070 A * 11/1978 Hill ..... 84/718
D256,366 S * 8/1980 Dworsky ..... D17/1
4,702,141 A * 10/1987 Bonanno ..... 84/626
4,794,838 A * 1/1989 Corrigau, III ..... 84/600
4,867,028 A * 9/1989 Jones ..... 84/735
5,403,972 A * 4/1995 Valentine, Sr. ..... 84/730
5,434,350 A * 7/1995 Haney et al. ..... 84/743
5,841,052 A * 11/1998 Stanton ..... 84/600
6,018,119 A * 1/2000 Mladek ..... 84/722
6,111,179 A * 8/2000 Miller ..... 84/442
6,777,608 B1 * 8/2004 Redding ..... 84/746
7,273,979 B2 * 9/2007 Christensen ..... 84/615
7,396,987 B1 * 7/2008 Tentindo ..... 84/423 R
7,667,119 B1 * 2/2010 Schlapkohl ..... 84/424
7,759,571 B2 * 7/2010 Ludwig ..... 84/723
7,928,312 B2 * 4/2011 Sharma ..... 84/719
2006/0123982 A1 * 6/2006 Christensen ..... 84/723
2012/0137859 A1 * 6/2012 Degerland ..... 84/731
2012/0180622 A1 * 7/2012 Sharma ..... 84/744

* cited by examiner

*Primary Examiner* — Jeffrey Donels
(74) *Attorney, Agent, or Firm* — Finnegan, Henderson, Farabow, Garrett & Dunner, LLP

(57) ABSTRACT

A keytar is disclosed. The keytar has a keyboard body having a front face, left side, right side and rear face. A piano-style keyboard with a number of keys is on the front face of the keyboard body. A neck extends from either the left or the right side and the left side of the keyboard body. A number of drum pads are on the front face of the keyboard body. A microprocessor is electrically connected to the drum pads. The microprocessor is configured and arranged to scan the state of each of the drum pads and generate a MIDI note signal corresponding to the state each drum pad. The keytar may further include an accelerometer to provide music effects and an internal sound engine to generate analog audio.

23 Claims, 3 Drawing Sheets

KEYTAR CONTROLLER WITH PERCUSSION PADS AND ACCELEROMETER

CROSS-REFERENCE TO RELATED APPLICATION

This patent document claims priority to earlier filed U.S. Provisional Application Ser. No. 61/489,876, filed May 25, 2011, the entire contents of which are incorporated herein by reference.

BACKGROUND

1. Technical Field

The present patent document relates generally electronic music instruments and controllers, and more particularly to an improved electronic keyboard instrument, called a "keytar".

2. Background of the Related Art

The "keytar" is a musical instrument with a piano-style keyboard that is worn with a strap like a guitar. It can have a built-in sound generator, or merely be a controller for an external sound generator.

The keytar is a relatively obscure but still established music instrument. A history of it can be found on Wikipedia:

http://en.wikipedia.org/wiki./Keytar.

Although keytars have all the versatility of a synthesizer, many musicians find using a keyboard to generate other types of sounds awkward. Because the keyboard keys abut one another, it is easy to strike multiple or the incorrect key. So, for instance, if a musician desires to play percussive sound using the keyboard keys, using a slap-style of play similar to a bass player is impractical.

Also, many keyboards include function controls, like a pitch-bend control, to apply effects to the sound of the keyboard. However, these controls require the use of two hands to operate the controls. Keytars suffer a disadvantage to typical synthesizer keyboard because keytars are played with one hand, like a guitar is strummed. Although the musician's second hand is free to operate other functions controls, many musicians find this arrangement awkward at best.

Therefore, there is a perceived need in the industry for an improved keytar that provides the ability to generate a wider range of sounds and provide better easier controls to operate the keyboard functions, which can lead to better showmanship for stage acts.

SUMMARY

The present invention solves the problems of the prior art by providing an improved keytar that includes a series of optimally placed drum pads and may also include an accelerometer configured to generate MIDI continuous controller values.

The improved keytar adds additional functionality to this instrument for greater performance and control possibilities. The included percussion pads enable drum sounds that can be more easily played on the instrument. Furthermore, the placement of the drum pads has been optimized to permit "slap bass" style of playing, which musicians find intuitive, and leads to dynamic performances. Specifically, these drum pads allow the musician to trigger drum sounds in a more natural and realistic way than using piano keys. The triggering method is very similar to how a bass player slaps the strings with his thumb and plucks with this fingers on a bass guitar. Thus, it is a very natural way of triggering percussive sounds.

Also, included is an accelerometer to determine if the instrument is tilted relative to the horizontal, in which case a MIDI continuous control is generated to modulate or affect the sound. For instance, the MIDI continuous control signal can be set to change the timbre, volume, or other parameter of a sound, offering new performance possibilities. As can be readily understood, the use of an accelerometer frees the musician to concentrate on playing the keytar. A side-effect of the accelerometer is also that it forces the musician to rock and tile the keytar which leads to a more physically expressive style of playing that entertains live audiences.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
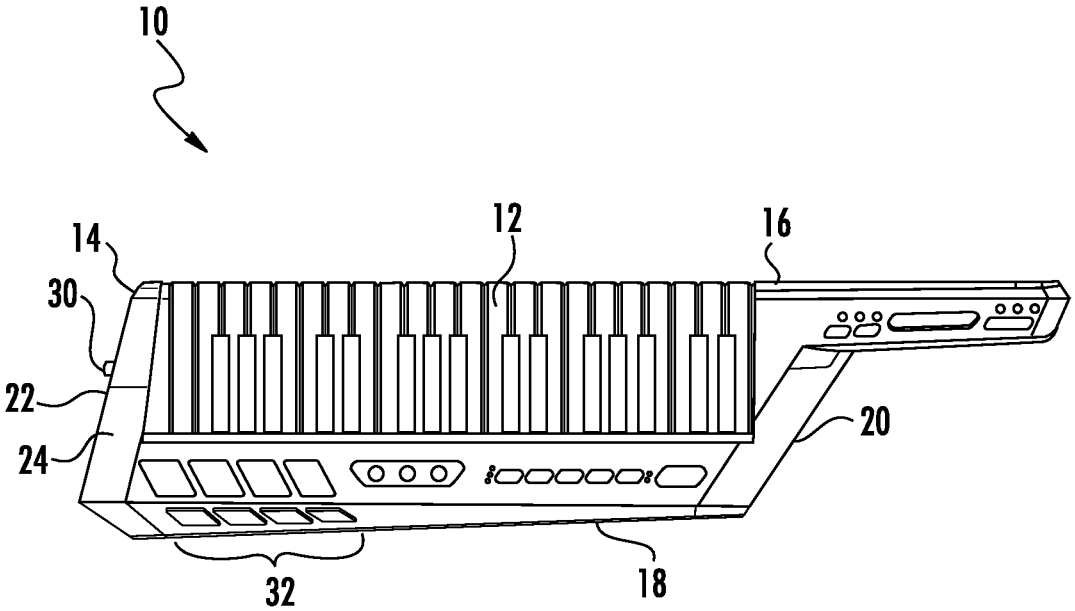
FIG. 1 is a front view of an improved keytar.
Figure 2:
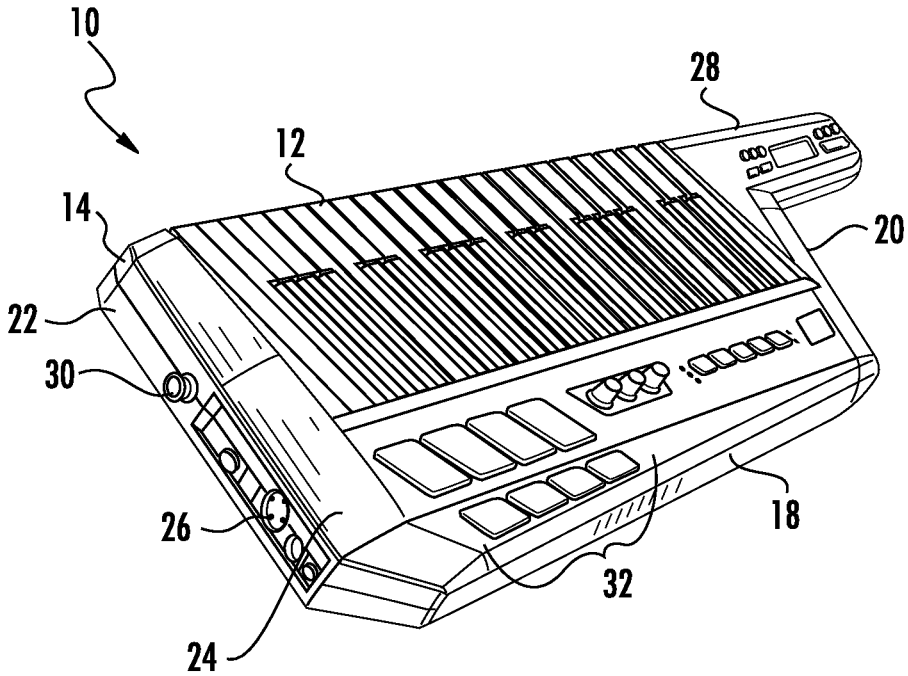
FIG. 2 is a front and right-side perspective view of the improved keytar.

Referring now to FIGS. 1 and 2, an embodiment of the improved keytar is shown generally at 10. The improved keytar 10 includes a piano-style keyboard 12 in a keyboard body 14. The keyboard body 14 generally includes a top 16, bottom 18, left side 20, right side 22, front 24 and back. For purposes of orienting the reader, the keyboard body 12 is described in relationship to a musician wearing the keytar 10. Thus the front 24 of the keyboard body 14 faces outwards from the musician, the back of the keyboard body 14 rests against the musician, and the left side 20 and right side 22 of the keyboard body 14 are on the left hand and right hand sides, respectively, of the musician.

The keytar 10 may include an internal sound generator, which generates and plays sound in response to presses on the keyboard keys, and as will be further described below, sounds from the drum pads. In addition, the keytar 10 may be configured to be a MIDI controller. That is, the keytar 10 will generate MIDI note data and transmit it to a computer, which will generate the sound. As a MIDI controller, the keytar 10 need not include an internal sound generator. MIDI outputs 26 are included on the keytar 10 to permit MIDI note data to be outputted to a computer, or other device that accepts MIDI inputs.

The keyboard body 14 includes a neck 28 extending from the left side 20 of the keyboard body 14, which functions as a handle for the musician's left hand and includes additional controls to change the functions of the keytar 10. A fastening point for a guitar strap to make the keytar 10 easier to carry may be located on the neck 28 or back of the keyboard body 12 as is known in the art. The second fastening point 30 for the strap is located on the right side 20 of the keyboard body 14. It is important to note that the keytar 10 described and shown herein is set up for right-handed musicians, meaning the musician's right hand is primarily used to play the keyboard 12 keys. One skilled in the art would find it elementary to reverse the structures to make a keytar 10 for left-handed musicians.

Located in the lower front 24 of the keytar body 14, so as to be easily accessible by the musician's right hand, are a number of drum pads 32. Locating the drum pads 32 in this area of the keyboard body 14 is a similar location as the strings of a bass guitar relative to the musician, so they may be "slapped" just like on a bass guitar, which is advantageous. The drum pads 32, as will be more fully described below, permit the musician to play percussion sounds with the keytar 10. These drum pads 32 may also be configured to trigger other percussion sounds, such as cymbals too.

Figure 3A:
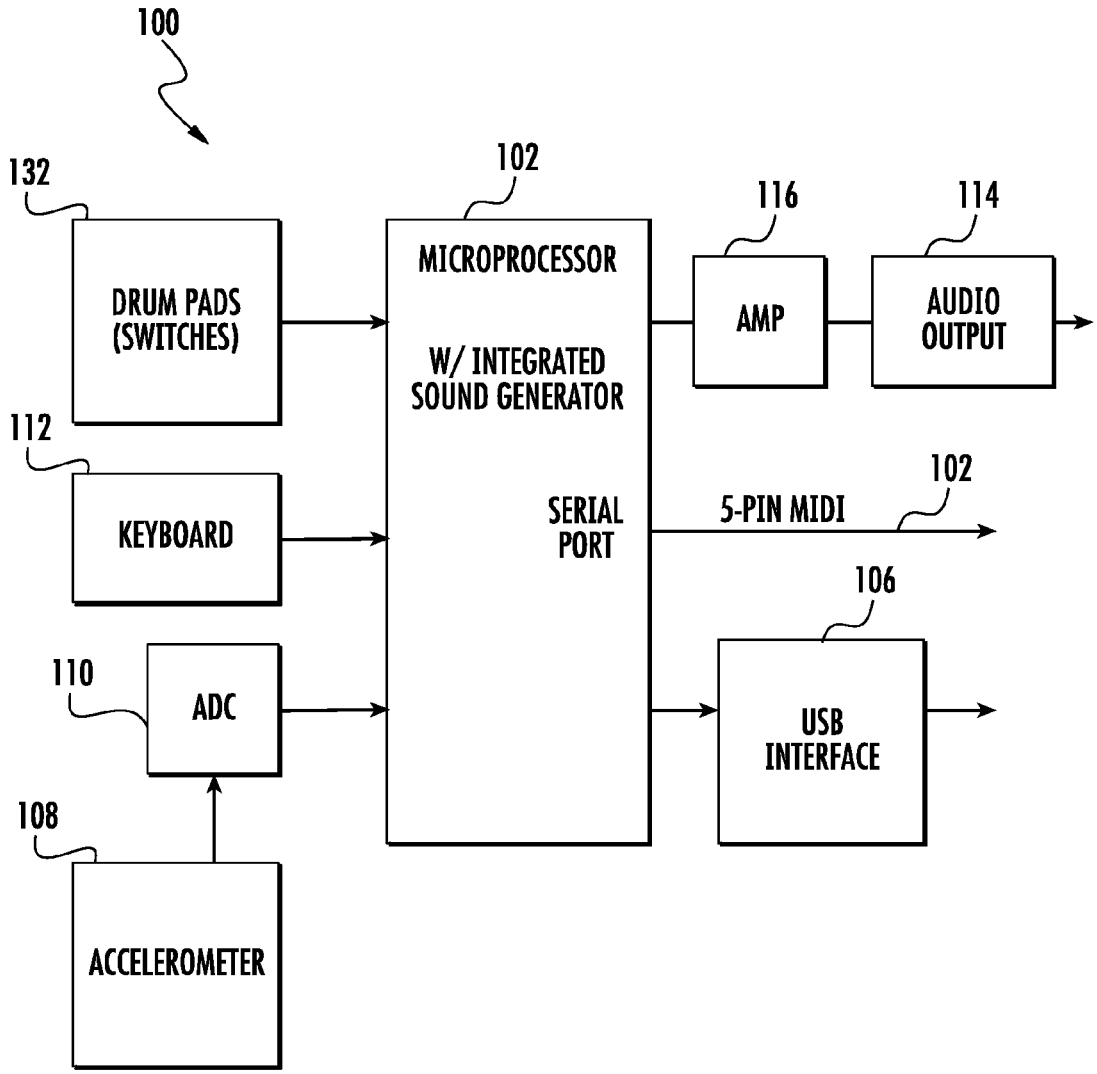
FIG. 3A is a diagram of the electrical operation of a first embodiment of the improved keytar with a microprocessor that may have an optional integrated sound generator with analog audio outputs.

Referring now to FIG. 3A, a first embodiment of the electrical operation of the keytar 10 is shown generally at 100. The keytar 10 includes a microprocessor 102 which constantly scans the state of the drum pads 132 (which may be activated or deactivated). Each drum pad 132 may be read by an individual port pin of the microprocessor 102. Alternatively, each drum pad 132 can be formed into a matrix of rows and columns and read by a smaller number of microprocessor pins, as is known in the art. Similarly, the keyboard 112 keys may also be read by the microprocessor 102 as well.

Each drum pad 132 and keyboard 112 key has a particular MIDI note assigned to it. When the microprocessor 102 detects that a particular drum pad 102 or keyboard 112 key has been activated, it sends a MIDI note "On" signal to the keytar's MIDI outputs 26 (which can be traditional 5-pin MIDI 104 or USB MIDI via a USB interface 106), and/or may be used by the keytar's 10 internal sound generator, if included, which may be integrated with the microprocessor 102.

To measure the tilt of the keytar 10, an accelerometer 108 is read by the microprocessor 102 through an analog to digital converter 110. The value of the accelerometer 108 is converted into a MIDI continuous controller value which is outputted from the keytar 10 to control an external synthesizer or computer. Also, the value of the accelerometer 108 may be used inside the keytar 10 to control an internal sound generator if included, which the sound would be routed through an audio output 114, such as a built-in speaker or audio output connectors that may be connected to external amplifiers. An amplifier 116 with optional volume control may be included on the audio output 114.

The analog to digital converter 110 and USB interface 106 might also be physically integrated on the same chip as the microprocessor 102, as is known in the art.

Figure 3B:
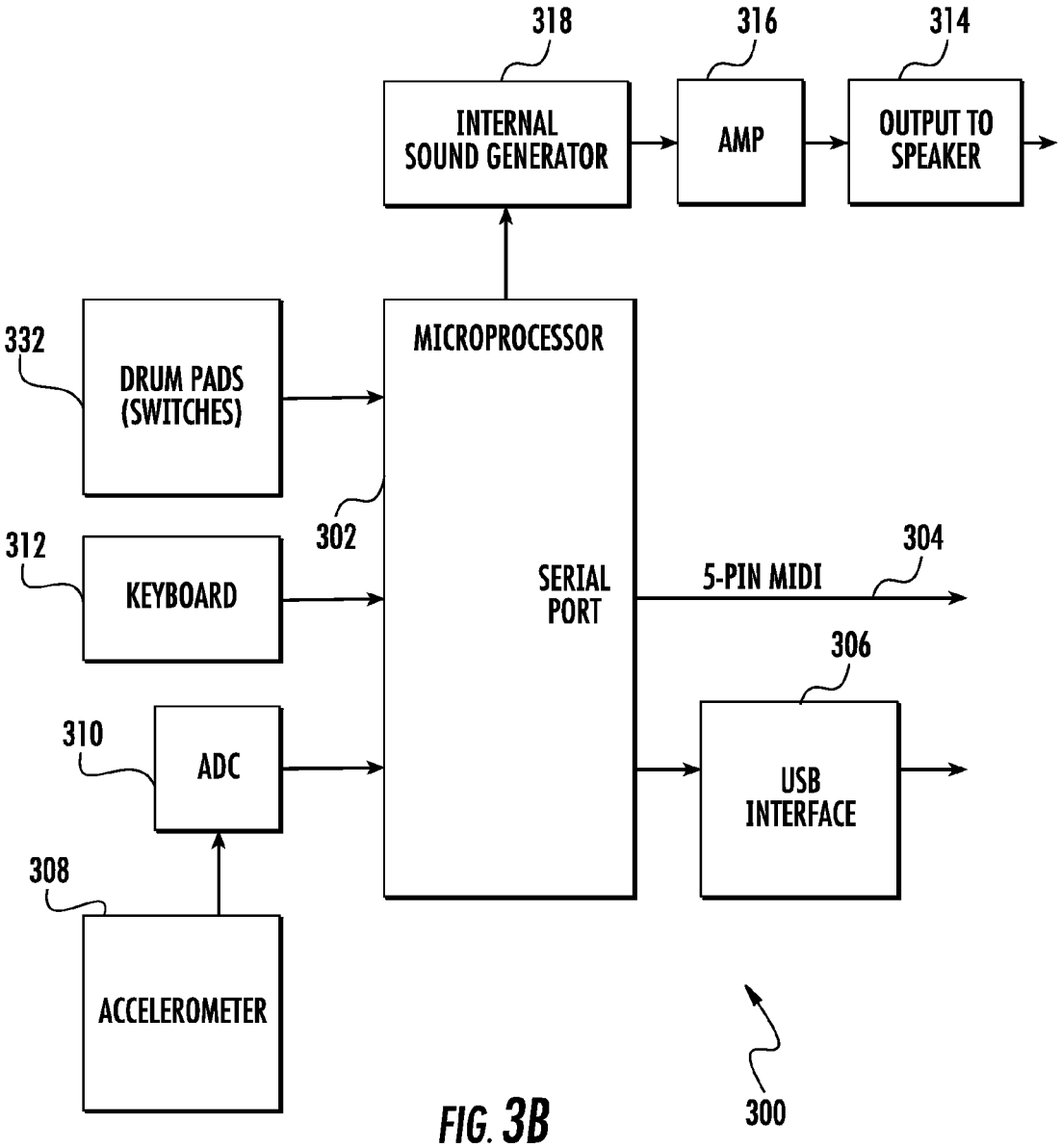
FIG. 3B is a diagram of the electrical operation of a third embodiment of the improved keytar having an optional and separate internal sound generator that receives input from the microprocessor.

Referring now to FIG. 3B, a second embodiment of the electrical operation of the keytar is shown generally at 300. The second embodiment generally describes the instance where a microprocessor 302 provides control inputs for an internal sound generator 318. The second embodiment 300 includes a microprocessor 302 which constantly scans the state of the drum pads 332 (which may be activated or deactivated). Each drum pad 332 may be read by an individual port pin of the microprocessor 302. Alternatively, each drum pad 332 can be formed into a matrix of rows and columns and read by a smaller number of microprocessor 332 pins, as is known in the art.

Each drum pad 332 has a particular MIDI note assigned to it. When the microprocessor 302 detects that a particular drum pad 332 has been activated, it sends a MIDI note "On" signal to the keytar's MIDI outputs (which can be traditional 5-pin MIDI 304 or USB MIDI via a USB interface 306), and/or may be used by the keytar's internal sound generator 318, if included. The internal sound generator 318 may then send analog audio to an audio output 314, which may include an amplifier 316 with optional volume control.

To measure the tilt of the keytar, an accelerometer 308 is read by the microprocessor 302 through an analog to digital converter 310. The value of the accelerometer 308 is converted into a MIDI continuous controller value which is outputted from the keytar to control an external synthesizer or computer. Also, the value may be inputted to the internal sound generator 318, if included.

The analog to digital converter 310 and USB interface 306 might also be physically integrated on the same chip as the microprocessor 302, as is known in the art.

Therefore, the improved keytar solves the problems of the prior art by providing an integrated drum pad and accelerometer functions into a keytar, which makes the keytar a more versatile instrument. Because the improved keytar is more versatile it breathes new life into an instrument that has been considered an oddity in the commercial market. The improved keytar will make this old instrument into a staple instrument of future bands.

It would be appreciated by those skilled in the art that various changes and modifications can be made to the illustrated embodiments without departing from the spirit of the present invention. All such modifications and changes are intended to be within the scope of the present invention.

What is claimed is:

1. A keytar, comprising:

a keyboard body having a front face, left side, right side and rear face;

a piano-style keyboard on the front face of the keyboard body having a plurality of keys;

a neck extending from one of the right side and the left side of the keyboard body;

a plurality of drum pads on the front face of the keyboard body;

a microprocessor electrically connected to the plurality of drum pads, the microprocessor configured and arranged to scan the state of each of the plurality of drum pads and generate a MIDI note signal corresponding to the state each of the plurality of drum pads; and an accelerometer electrically connected to the microprocessor, the accelerometer configured and arranged to detect movement of the keyboard body and generate a signal corresponding thereto, the microprocessor configured and arranged to generate a MIDI continuous control signal corresponding to the signal generated by the accelerometer.

2. The keytar of claim 1, wherein the microprocessor is electrically connected to the piano-style keyboard and further configured and arranged to generate a MIDI note signal corresponding to the state of each of the plurality of keys.

3. The keytar of claim 1, further comprising an internal sound engine electrically connected to the piano-style keyboard and configured and arranged to generate audio output corresponding to presses of the plurality of keys.

4. The keytar of claim 3, wherein the internal sound engine is electrically connected to the plurality of drum pads and configured and arranged to generate audio output corresponding to presses of the plurality of drum pads.

5. The keytar of claim 1, wherein the neck extends from the left side of the keyboard body.

6. The keytar of claim 1, wherein the plurality of drum pads are adjacent to the right side of the keyboard body.

7. A keytar, comprising:

a keyboard body having a front face, left side right side and rear face;

a piano-style keyboard on the front face of the keyboard body having a plurality of keys;

a neck extending from one of the right side and the left side of the keyboard body;

a plurality of drum pads on the front face of the keyboard body;

an accelerometer configured and arranged to detect movement of the keyboard body and generate a signal corresponding thereto;

a microprocessor electrically connected to the plurality of drum pads and the accelerometer, the microprocessor configured and arranged to scan the state of each of the plurality of drum pads and generate a MIDI note signal corresponding to the state each of the plurality of drum pads, the microprocessor configured and arranged to generate a MIDI continuous control signal corresponding to the signal generated by the accelerometer.

8. The keytar of claim 7, wherein the microprocessor is electrically connected to the piano-style keyboard and further configured and arranged to generate a MIDI note signal corresponding to the state of each of the plurality of keys.

9. The keytar of claim 7, further comprising an internal sound engine electrically connected to the piano-style keyboard and configured and arranged to generate audio output corresponding to presses of the plurality of keys.

10. The keytar of claim 9, wherein the internal sound engine is electrically connected to the plurality of drum pads and configured and arranged to generate audio output corresponding to presses of the plurality of drum pads.

11. The keytar of claim 7, wherein the neck extends from the left side of the keyboard body.

12. The keytar of claim 7, wherein the plurality of drum pads are adjacent to the right side of the keyboard body.

13. A keytar, comprising:

a keyboard body having a front face, left side right side and rear face;

a piano-style keyboard on the front face of the keyboard body having a plurality of keys;

a neck extending from one of the right side and the left side of the keyboard body;

a plurality of drum pads on the front face of the keyboard body;

an accelerometer configured and arranged to detect movement of the keyboard body and generate a signal corresponding thereto;

a microprocessor electrically connected to the plurality of drum pads and the accelerometer, the microprocessor configured and arranged to scan the state of each of the plurality of drum pads and generate a MIDI note signal corresponding to the state each of the plurality of drum pads, the microprocessor further configured and arranged to generate a MIDI continuous control signal corresponding to the signal generated by the accelerometer, the microprocessor further configured and arranged to generate a MIDI note signal corresponding to the state of each of the plurality of keys.

14. The keytar of claim 13, further comprising an internal sound engine electrically connected to the piano-style keyboard and configured and arranged to generate audio output corresponding to presses of the plurality of keys.

15. The keytar of claim 14, wherein the internal sound engine is electrically connected to the plurality of drum pads and configured and arranged to generate audio output corresponding to presses of the plurality of drum pads.

16. The keytar of claim 14, wherein the internal sound engine is electrically connected to the accelerometer and configured and arranged to generate apply a music effect to the audio output.

17. The keytar of claim 15, wherein the internal sound engine is electrically connected to the accelerometer and configured and arranged to generate apply a music effect to the audio output.

18. The keytar of claim 13, wherein the neck extends from the left side of the keyboard body.

19. The keytar of claim 13, wherein the plurality of drum pads are adjacent to the right side of the keyboard body.

20. A keytar, comprising:

a keyboard body having a front face, left side right side and rear face;

a piano-style keyboard on the front face of the keyboard body having a plurality of keys;

a neck extending from one of the right side and the left side of the keyboard body;

an accelerometer configured and arranged to detect movement of the keyboard body and generate a signal corresponding thereto;

a microprocessor electrically connected to the accelerometer, the microprocessor configured and arranged to generate a MIDI continuous control signal corresponding to the signal generated by the accelerometer.

21. The keytar of claim 20, further comprising a plurality of drum pads on the front face of the keyboard body; the microprocessor electrically connected to the plurality of drum pads, the microprocessor configured and arranged to scan the state of each of the plurality of drum pads and generate a MIDI note signal corresponding to the state each of the plurality of drum pads.

22. The keytar of claim 20, wherein the microprocessor is electrically connected to the piano-style keyboard and further configured and arranged to generate a MIDI note signal corresponding to the state of each of the plurality of keys.

23. The keytar of claim 20, further comprising an internal sound engine electrically connected to the piano-style keyboard and configured and arranged to generate audio output corresponding to presses of the plurality of keys.

* * * * *